US006087992A

United States Patent [19]

Anderson

[11] Patent Number: 6,087,992

[45] Date of Patent: Jul. 11, 2000

[54] ACOUSTICALLY DRIVEN PLASMA ANTENNA

[75] Inventor: Theodore R. Anderson, West Greenwich, R.I.

[73] Assignee: The United States of America as represented by the Secretary of the Navy, Washington, D.C.

[21] Appl. No.: 09/273,817

[22] Filed: Mar. 22, 1999

[51] Int. Cl.[7] ..... H01Q 1/26

[52] U.S. Cl. ..... 343/701; 315/111; 333/99 PL; 250/282

[58] Field of Search ..... 343/701; 333/99 PL; 315/111, 111.4; 250/281, 282, 287, 423; 53/15, 17

[56] References Cited

U.S. PATENT DOCUMENTS 3,914,766 10/1975 Moore ..... 343/701

4,066,893 1/1978 Dawson ..... 250/282

4,185,213 1/1980 Scannell ..... 310/11

*Primary Examiner*—Don Wong

*Assistant Examiner*—Tho Phan

*Attorney, Agent, or Firm*—Michael J. McGowan; Robert W. Gauthier; Prithvi C. Lall

[57] ABSTRACT

A plasma antenna with an acoustic modulator is provided. An ionizer produces a plasma in a horizontal tube to form a bounded plasma column extending along a longitudinal axis. An amplitude-, phase- or frequency-modulated signal is applied to an acoustic transducer that directs an acoustic wave along the longitudinal axis into the plasma. The acoustic wave acts as an ion acoustic wave to oscillate ions parallel to the axis. This movement radiates an amplitude-, phase- or frequency-modulated electromagnetic field from the plasma column.

16 Claims, 3 Drawing Sheets

ACOUSTICALLY DRIVEN PLASMA ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to communications antennas, and more particularly to plasma antennas adaptable for use in any of a wide range of frequencies.

(2) Description of the Prior Art

A specific antenna typically is designed to operate over a narrow band of frequencies. However, the underlying antenna configuration or design may be adapted or scaled for widely divergent frequencies. For example, a simple dipole antenna design may be scaled to operate at frequencies from the 3–4 MHz band up to the 100 MHz band and beyond.

At lower frequencies the options for antennas become fewer because the wavelengths become very long. Yet there is a significant interest in providing antennas for such lower frequencies including the Extremely Low Frequency (ELF) band, that is less than 3 kHz, the Very Low Frequency (VLF) band including signals from 20 kHz to 60 kHz and the Low Frequency (LF) band with frequencies in the 90 to 100 kHz band. However, conventional half-wave and quarter-wave antenna designs are difficult to implement because at 100 Hz, for example, a quarter-wave length is of the order of 750 km.

Notwithstanding these difficulties, antennas for such frequencies are important because they are useful in specific applications, such as effective communications with a submerged submarine. For such applications, conventional ELF antennas comprise extremely long, horizontal wires extended over large land areas. Such antennas are expensive to construct and practically impossible to relocate at will. An alternative experimental Vertical Electric Dipole (VEP) antenna uses a balloon to raise one end of a wire into the atmosphere to a height of up to 12 km or more. Such an antenna can be relocated. To be truly effective the antenna should extend along a straight line. Winds, however, can deflect both the balloon and wire to produce a catenary form that degrades antenna performance. Other efforts have been directed to the development of a corona mode antenna. This antenna utilizes the corona discharges of a long wire to radiate ELF signals.

Still other current communication methods for such submarine and other underwater environments include the use of mast mounted antennas, towed buoys and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. For both towed buoys and towed submersed arrays, speed must be decreased to operate the equipment. Consequently, as a practical matter, the use of such antennas for ELF or other low frequency communications is not possible because they require too much space.

Conventional plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated.

With respect to plasma antennas, U.S. Pat. No. 1,309,031 to Hettinger discloses an aerial conductor for wireless signaling and other purposes. The antenna produces, by various means, a volume of ionized atmosphere along a long beam axis to render the surrounding atmosphere more conductive than the more remote portions of the atmosphere. A signal generating circuit produces an output through a discharge or equivalent process that is distributed over the conductor that the ionized beam defines and that radiates therefrom.

U.S. Pat. No. 3,404,403 to Vellase et al. uses a high power laser for producing the laser beam. Controls repeatedly pulse and focus the laser at different points thereby to ionize a column of air. Like the Hettinger patent, a signal is coupled onto the ionized beam.

U.S. Pat. No. 3,719,829 to Vaill discloses an antenna constructed with a laser source that establishes an ionized column. Improved ionization is provided by means of an auxiliary source that produces a high voltage field to increase the initial ionization to a high level to form a more highly conductive path over which useful amounts of electrical energy can be conducted for the transmission of intelligence or power. In the Hettinger, Vellase et al. and Vaill patents, the ionized columns merely form vertical conductive paths for a signal being transmitted onto the path for radiation from that path.

U.S. Pat. No. 3,914,766 to Moore discloses a pulsating plasma antenna, which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement.

U.S. Pat. No. 5,450,223 to Wagner et al. discloses an optical demultiplexer for optical/RF signals. The optical demultiplexer includes an electro-optic modulator that modulates a beam of light in response to a frequency multiplexed radio-frequency information signal.

U.S. Pat. No. 5,594,456 to Norris et al. discloses an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

A number of other references disclose various components for the production of ion beams and ion plasma. For example, U.S. Pat. No. 5,017,835 to Oeschner discloses a high-frequency ion source for production of an ion beam. The source comprises a tubular vessel shaped to match the desired shape of the beam and designed to accommodate an ionizable gas. A coil surrounds the vessel and is coupled to a high-frequency generator through a resonant circuit. A Helmholtz coil pair matched to the shape of the vessel generates a magnetic field directed normally to the axis of the coil surrounding the vessel.

U.S. Pat. No. 5,225,740 to Ohkawa discloses a method and apparatus for producing a high density plasma. The plasma is produced in a long cylindrical cavity by the excitation of a high-frequency whistler wave within the cavity. This cavity and the plasma are imbedded in a high magnetic field with magnetic lines of force passing axially or longitudinally through the cavity. Electromagnetic energy is then coupled axially into the cylindrical cavity using a resonant cavity. In one embodiment electromagnetic energy is coupled radially into the cylindrical cavity using a slow wave structure.

U.S. Pat. No. 5,350,454 to Ohkawa discloses a plasma processing apparatus for controlling plasma constituents using neutral and plasma sound waves. The plasma sound wave comprises a periodic wave form controlled to include at least a second harmonic component. Applying the sound wave imparts a drift velocity to contaminant particles, such as micronized dust particles. The drift velocity, including its direction, is controlled by controlling the harmonic content, intensity and/or phase of the neutral or plasma sound wave.

U.S. Pat. No. 5,648,701 to Hooke et al. discloses electrode designs for high pressure magnetically assisted inductively coupled plasmas. The plasma is formed in a vessel at a pressure of at least 100 mtorr. An antenna with a substantially planar face is positioned adjacent a portion of the vessel for applying an electromagnetic field to the plasma gas thereby to generate and maintain a plasma. Another magnetic field is also applied with a component in a direction substantially perpendicular to the planar face of the antenna.

U.S. Pat. No. 5,594,456 to Norris et al. discloses a gas-filled tube for operating as an rf antenna that transmits a short pulse duration signal of predetermined radio frequency and that eliminates any trailing antenna resonance signal. A voltage source develops an electrically conductive path along the length of the tube corresponding to a resonant wavelength multiple of the predetermined radio frequency. A signal transmission source coupled to the tube supplies a radio frequency signal to the conductive path.

Notwithstanding the disclosures in the foregoing references, applications for ELF frequencies still use conventional land-based antennas commonly called Horizontal Electric Dipole (HED) antennas. There remains a requirement for an antenna that can be mast mounted or otherwise use significantly less space than the existing conventional land-based antennas for enabling the transmission of signals at various frequencies, included ELF and other low-frequency signals, for transmission in an underwater environment.

SUMMARY OF THE INVENTION

Accordingly it is an object of the present invention to provide an antenna capable of operation with ELF signals.

Another object of this invention is to provide an antenna that is capable of transmitting signals in different frequency ranges including the ELF range.

Still another object of this invention is to provide an ELF antenna that is transportable.

Yet another object of this invention is to provide an ELF antenna that can be mounted in a restricted volume.

In accordance with this invention, an antenna is formed by providing a plasma column in a defined volume extending along a longitudinal axis. Modulated acoustic energy is applied to the plasma column. The resulting acoustic waves become ion acoustic waves in the plasma that oscillate ions and electrons in the plasma along the direction of the longitudinal axis. The reciprocating ions and electrons radiate a modulated electromagnetic field from the plasma.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
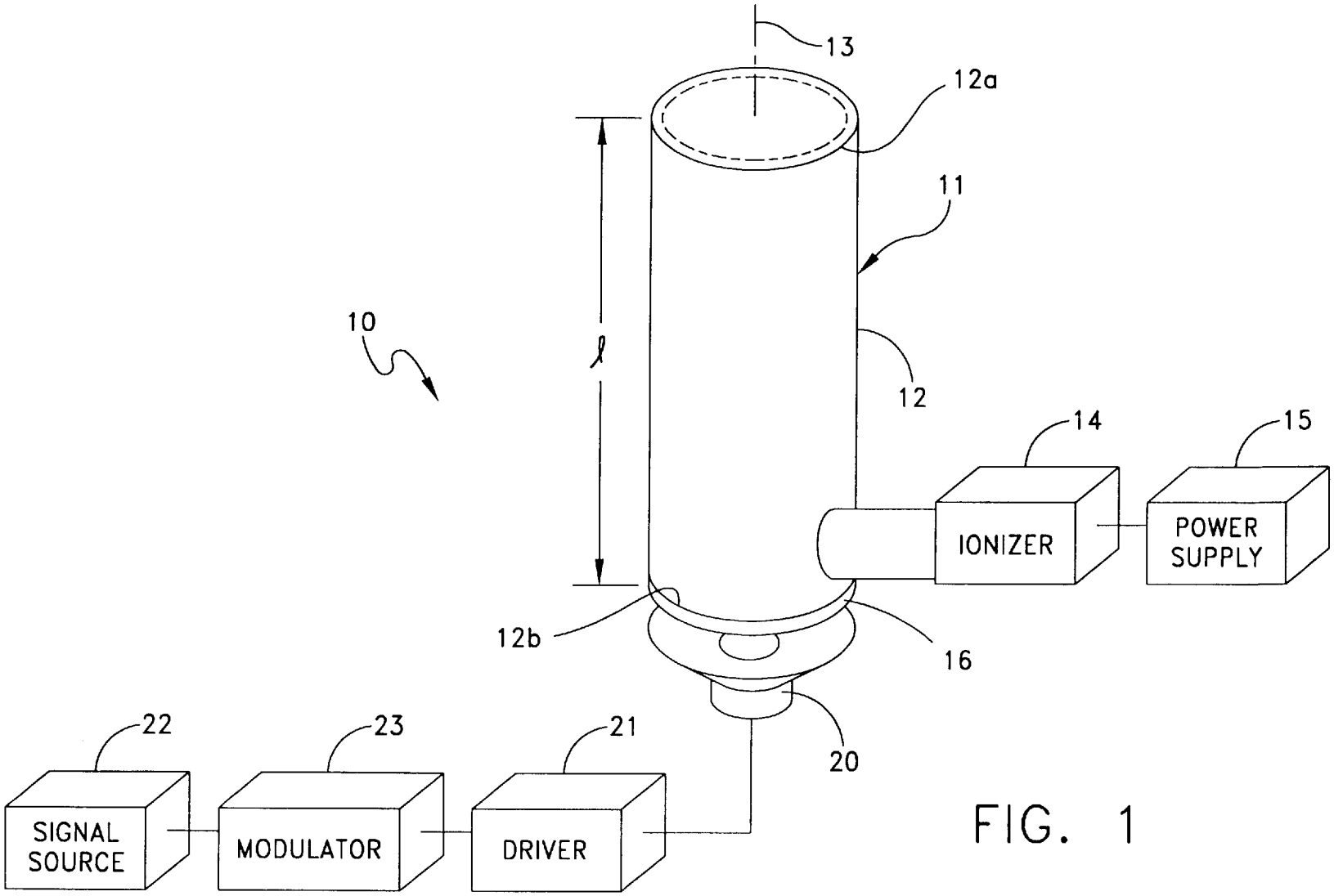
FIG. 1 is a schematic view that depicts one embodiment of an acoustically driven plasma antenna according to this invention.

FIG. 1 depicts a transmitter system 10 that includes a plasma antenna 11 constructed in accordance with this invention. As will become apparent this system is capable of transmitting signals over a wide range of frequencies including extra low frequencies (i.e., in the ELF range).

The plasma antenna 11 includes a closed end tube 12 that extends along a longitudinal axis 13. The axis is vertically orientated in FIG. 1, but can be at any oblique or horizontal orientation. The tube 12 is filled with an ionizable gaseous medium. The gaseous medium can comprise atmospheric gas or any of the inert gases.

An ionizer 14 and power supply 15 provide a mechanism for maintaining a plasma within the tube 12. The ionizer may comprise a laser, a rf generator or an arc discharge device or any other device capable of producing the plasma within the closed volume defined by the tube 12. The basic criterion is that the medium within the tube 12 and the ionizer 14 have the capability of maintaining an electron density of at least $10^{12}$ electrons per cubic centimeter within the plasma. Pulsed $CO^2$ or Nd:YAG lasers are examples of mechanisms for providing such ionizing functions. Although FIG. 1 depicts the ionizer 14 and power supply 15 as being positioned at the side of the tube 12, the ionizer itself could be located at the end of the tube such as the top 12*a* of tube 12 shown in FIG. 1.

One end of the tube 12, the bottom end 12*b* in FIG. 1, will be closed by an acoustic window 16 adapted to allow an acoustic wave at the normal operating frequency for the transmitting system 10 to transfer into the plasma with minimal attenuation and distortion. Such acoustic windows are well known in the art.

An electro-acoustic transducer, shown as a speaker 20, is positioned to direct an acoustic wave along the longitudinal axis 13 through the plasma in the tube 12. The driving force is provided by a driver circuit 21 that is constituted by a power amplifier capable of providing an acoustic wave of adequate power as will be described later. A signal source 22 generates a message to be transmitted over time. A modulator 23 amplitude modulates, phase modulates or frequency modulates a carrier frequency by the signal to be transmitted. For example, the carrier frequency for an ELF application might be 100 Hz. The driver 21 then amplifies this ELF modulated carrier having a 100 Hz nominal frequency for producing an acoustic wave transmitted from the speaker 20.

As the acoustic wave generated by the speaker 20 propagates through the window 16 and the plasma in the tube 12, it can be considered to be an ion acoustic wave. The result is the formation of pressure gradients that produce ion and electron motion within the plasma.

Figure 2:
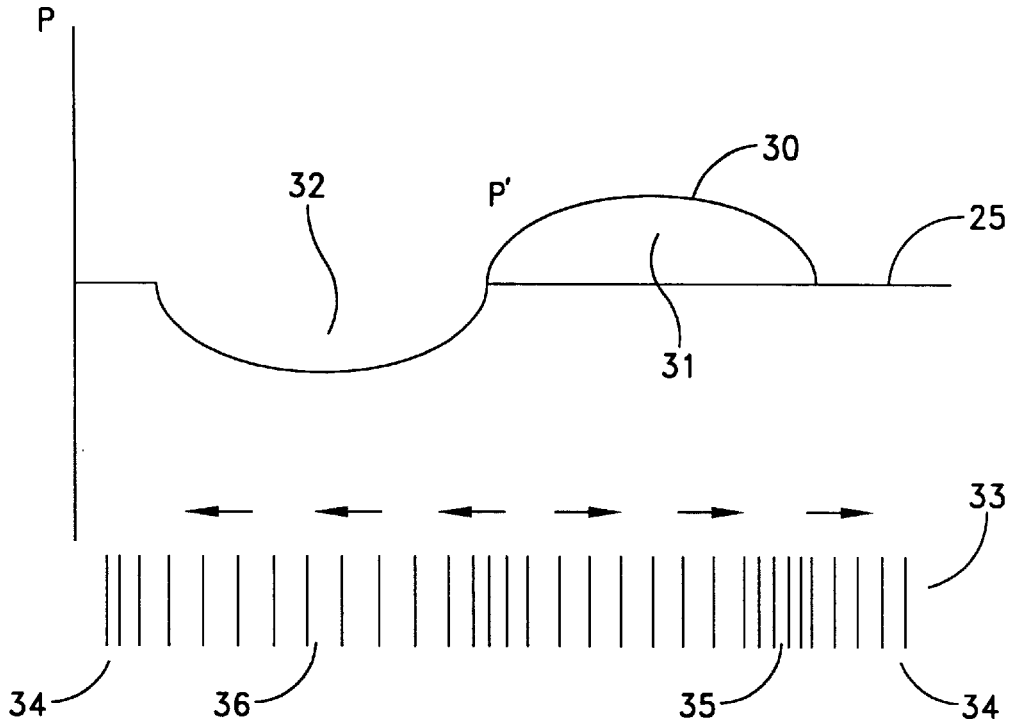
FIG. 2 is a graph that is useful in understanding the operation of the antenna in FIG. 1.

FIG. 2 depicts the effect of a horizontally propagated acoustic wave as it passes through a plasma along an axis 25. The acoustic wave is represented as a graph 30 with an area 31 of increased pressure and an area 32 of decreased pressure. Assume the spacing of the lines in graph 33 depicts the density of the ions and electrons throughout the tube in response to the wave and that the line spacing at 34 represents the normal density of those particles. In the area 31 of increased pressure there will be an increased density of particles at 35 whereas the density will be rarefracted at an area 36 corresponding to the area 32 of decreased pressure area.

Figure 3:
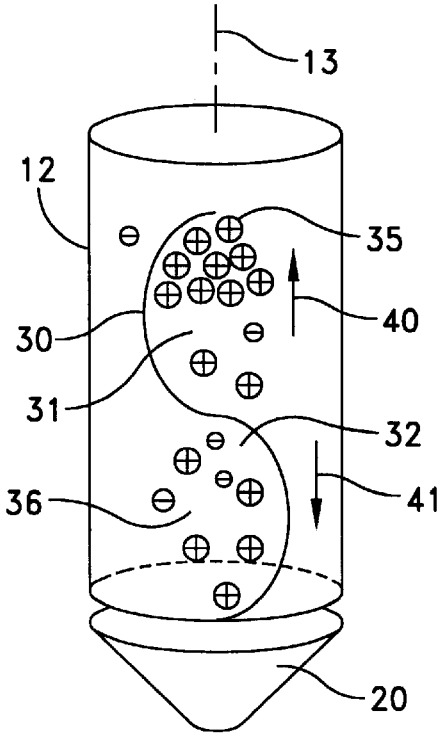
FIG. 3 is a schematic view of a portion of the plasma antenna that is useful in understanding this invention.

This is also shown in FIG. 3 where the pressure wave is shown as propagating along the vertical axis 13 of the tube 12 with the area 31 of increased pressure producing the concentration of ions and electrons at 35. The area 32 of decreased pressure produces the rarefracted density of ions and electrons at 36. As the wave moves through the plasma along the axis 13, areas of high density will produce an upward particle flow depicted by upward directed arrow 40 whereas in areas of reduced pressure the ion electron motion will be in the direction of downward directed arrow 41. Thus, the particles will reciprocate or oscillate in a vertical direction as an ion acoustic wave travels through the plasma in the tube 12.

Stated differently and as known, an ion acoustic wave is a longitudinal pressure wave in which the ions provide the inertia and the electrons the restoring force. Hence the ion acoustic wave can be considered an ion oscillation. At a resonance ion frequency, the ions will have much more charge density than electrons oscillating at the electron resonance frequency. As a consequence, the ions oscillating at resonance and the carrier frequency, including frequencies in the ELF range, can provide greater charge movement and a greater dipole moment than the electrons. Consequently, the current caused by the moving particles can be considered as being solely the result of ion travel.

With this background, certain quantitative aspects of the antenna system 11 in FIG. 1 can be disclosed. First, the S relationship between velocity wave length and frequency of an acoustic wave is given as:

$$\lambda_a f_a = v_a \tag{1}$$

wherein $v_a$=the velocity of an acoustic wave in air or in the medium in the tube 12, $\lambda_a$ is the acoustic wave length and $f_a$ is the acoustic frequency. Because the acoustic velocity is low, the tube length of this device can be extremely short with respect to that of a conventional antenna. For example, whereas a full wave length at 100 Hz is 3,200 km, in an acoustic wave, that has an acoustic velocity $v_a$=333 m/s, a 100 Hz wave has a full wavelength of 3.33 meters. Consequently, if the tube 12 and the plasma column in that tube is at least 3.33 meters long, i.e., 1>3.333 m, a modulated signal at 100 Hz should be radiated from the plasma. The antenna, therefore is significantly shorter than a conventional full wave antenna. Moreover, in the ELF range, any form of standing wave antenna that produces effective levels of electromagnetic radiation will be even shorter.

If it is assumed that the acoustic wave has a sinusoidal form, the acoustic pressure p is expressed as:

$$p = p_{pk} \cos(\omega t - kz - \phi) \tag{2}$$

where $p_{pk}$ represents the peak pressure induced by the acoustic wave, ω is the frequency, k is the wave number and ϕ is a phase shift. As also known, the acoustic particle velocity for ions is:

$$\vec{v} = \frac{\hat{z}}{\rho c} p_{pk} \cos(\omega t - kz + \phi) \tag{3}$$

where $\hat{z}$ represents a unit vector, ρ is the density of the medium and c is the speed in the medium (i.e., 333 m/s in the atmosphere). Thus the ions will oscillate at the acoustic frequency and cause the radiation of an electromagnetic field at that frequency.

For a sinusoidal wave, the acoustic intensity is:

$$I = \frac{[p^2]_{avg}}{\rho c} \tag{4}$$

and the acoustic power $P_{ac}$ is given as:

$$P_{ac} = \frac{P^2}{\rho c} A \tag{5}$$

where A represents the cross-sectional area of the plasma column, normal to the axis 13 in FIG. 1 and $[p^2]_{avg}$ represents the average value of the pressure squared.

As known, the conversion of energy in an antenna establishes the following relationship between input power, $P_{in}$, and output power $P_{out}$ as:

$$P_{in} = \frac{p^2}{\rho c} A = P_{out} + Loss \tag{6}$$

where Loss represents Bremestraulng and other losses produced within the plasma and the conversion into electromagnetic energy. These are expected to be small.

Using the known acoustic power equation, acoustic power dB can be converted to pressure by:

$$p_s^2 = p_{ref}^2 \cdot 10^{\frac{L_p}{10}} \tag{7}$$

where $p_s$ represents the pressure of the sound, $P^2_{ref}=20\times10^{-6}$ and $L_p$ is the sound pressure dB. Solving equation (6) by substituting equation (7) yields:

$$P_{out} = \frac{p_s^2}{\rho c} A = \frac{p_{ref}^2}{\rho c} \cdot 10^{\frac{Lp}{10}} \cdot A \tag{8}$$

Equation (8) represents the relationship between acoustic power, radiated power and the cross-sectional area of the tube 12 assuming losses can be ignored.

Figure 4:
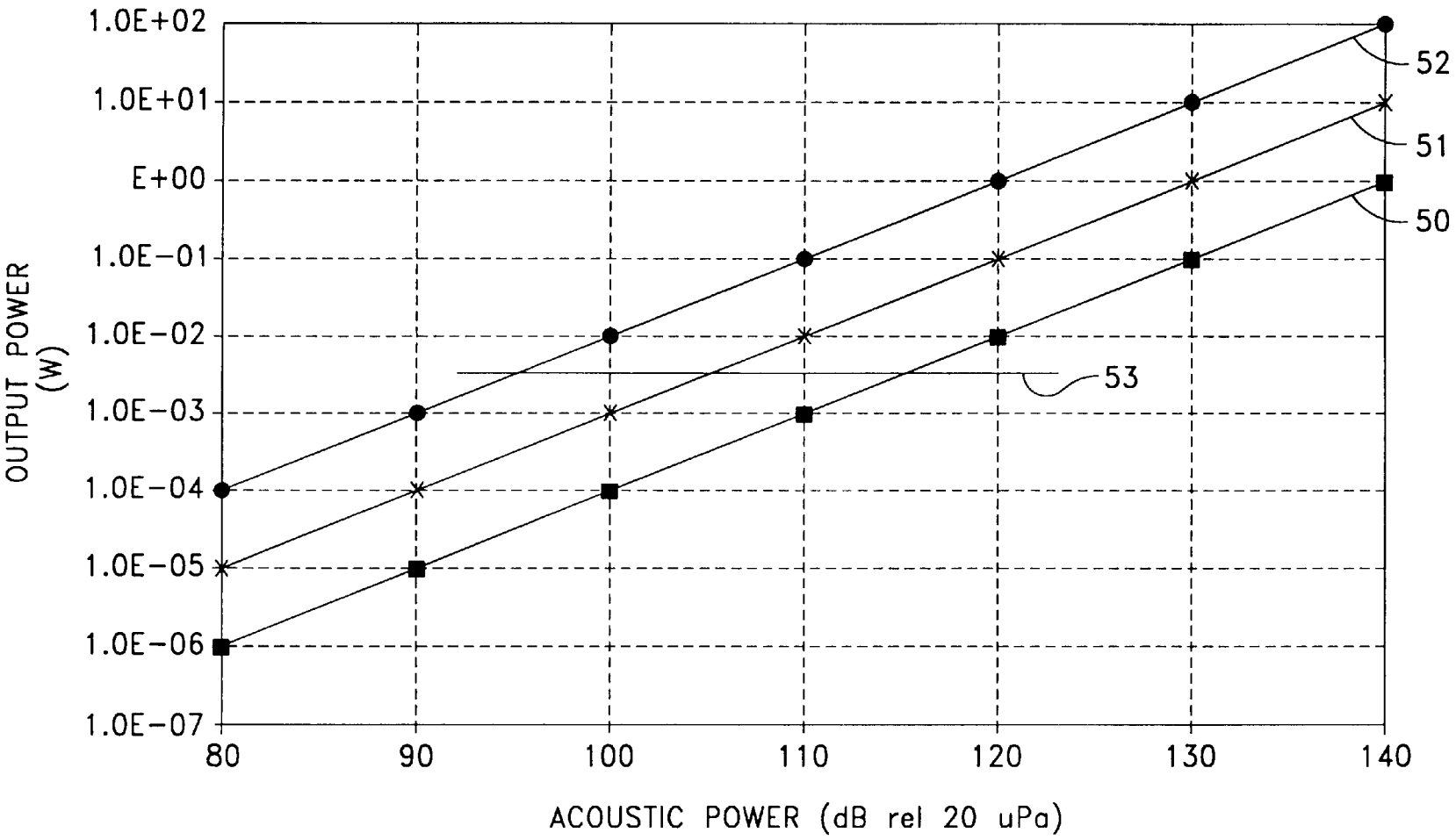
FIG. 4 presents a series of graphs depicting the operation of the antenna under various operating conditions.

Graph 50 in FIG. 4 depicts the relationship between acoustic input power and radiated output power over the range from 80 to 140 dB for the input power for a column having a diameter of 0.01 $m^2$. Graph 51 represents an increase of area of a factor of 10. This increase produces a ten-fold increase in radiated power. Graph 52 depicts the output power as a function of acoustic power for another factor of 10 in the increasing cross-sectional area for the tube 12. It again produces about a 10-fold increase in the output power from the antenna.

Graph 53 depicts the output power from a conventional Corona Mode Antenna (CMA) operating in a corresponding frequency range. If the acoustic wave energy exceeds about 105 dB, then the power out of the antenna 11 shown in FIG. 1 will be greater than the power of the conventional antenna. As will be apparent, this improved operating result will be achieved with a mechanism that is significantly less cumbersome and much more compact than a conventional CMA antenna.

Further, as will be apparent from FIG. 1, the antenna system and even its corresponding ionizer, power supply, signal source, modulator and driver can all be mounted in such a way to allow the structure to be a mobile structure. There is no need for any aerostats of supported CMA transmitting antennas and other elements that require large spaces.

Thus, in summary, in accordance with this invention, a plasma is excited externally by an acoustic wave that becomes an ion acoustic wave in the plasma. The ion acoustic wave produces ion oscillations that, in turn, radiate an electromagnetic field corresponding to the acoustic pressure developed by the acoustic wave. This antenna allows a significant reduction in antenna length, especially for ELF and other low frequencies. Thus, the system constructed in accordance with this invention meets the several objectives of this invention.

This invention has been described in terms of specific implementations. As described, lasers or other ionizing mechanisms can be used to provide the plasma. A speaker has been disclosed as an electromagnetic transducer. Other transducers may also be substituted. Therefore, it is the intent of the appended claims to cover all such variations and modifications as come within the true spirit and scope of this invention.

What is claimed is:

1. An antenna comprising:

plasma means for providing a plasma gas column in a defined volume extending along a longitudinal axis; and modulating means for applying modulated acoustic energy to said plasma whereby an acoustic wave becomes an ion acoustic wave in the plasma that oscillates ions and electrons in the plasma along the direction of the longitudinal axis thereby to radiate a modulated electromagnetic field from the plasma.

2. An antenna as recited in claim 1 wherein said plasma means comprises:

a defined column extending along the longitudinal axis containing an ionizable gas; and ionizing means for ionizing the gas in said defined column.

3. An antenna as recited in claim 2 wherein the antenna is to operate at a frequency, f, and the length, l, of the defined column is given by:

$$l = \frac{V}{f}$$

where V is the acoustic velocity.

4. An antenna as recited in claim 2 wherein said modulating means comprises:

means for generating a signal to be transmitted by said antenna; and transducer means for generating an acoustic wave along the longitudinal axis in response to the signal.

5. An antenna as recited in claim 1 wherein said modulating means comprises:

means for generating a signal to be transmitted by said antenna; and transducer means for generating an acoustic wave in response to the signal.

6. An antenna as recited in claim 5 wherein said transducer applies acoustic energy to said plasma with an acoustic power given by:

$$p_{ac} = \frac{p^2}{\rho c} A$$

where P is the acoustic pressure, ρ is the density of the plasma, c is the speed of acoustic waves in the plasma and A is the cross sectional area of the plasma column.

7. An antenna as recited in claim 6 wherein said plasma means comprises:

a defined column extending along the longitudinal axis containing an ionizable gas; and ionizing means adjacent said defined column and disposed on the longitudinal axis for ionizing the gas in said defined column.

8. An antenna as recited in claim 7 wherein the antenna is to operate at a frequency, f, and the length, l, of the defined column is given by:

$$l = \frac{V}{f}$$

where V is the acoustic velocity.

9. A method for radiating an electromagnetic field modulated in response to a signal comprising the steps of:

producing a plasma gas column in a defined volume extending along a longitudinal axis; and applying modulated acoustic energy to said plasma whereby an acoustic wave becomes an ion acoustic wave in the plasma that oscillates ions and electrons in the plasma along the direction of the longitudinal axis thereby to radiate a modulated electromagnetic field from the plasma.

10. A method as recited in claim 9 wherein said plasma production includes the steps of:

defining a column extending along the longitudinal axis containing an ionizable gas; and ionizing the gas in said defined column to produce a plasma.

11. A method as recited in claim 10 wherein an antenna formed by the column is to operate at a frequency, f, and the length, l, of the defined column is given by:

$$l = \frac{V}{f}$$

where V is the acoustic velocity.

12. A method as recited in claim 10 wherein said modulating step comprises the steps of:

generating a signal to be transmitted; and generating an acoustic wave along the longitudinal axis in response to the signal.

13. A method as recited in claim 9 wherein said modulating step comprises the steps of:

generating a signal to be transmitted; and generating an acoustic wave in response to the signal.

14. A method as recited in claim 13 wherein the acoustic wave has an acoustic power given by:

$$p_{ac} = \frac{p^2}{\rho c} A$$

where P is the acoustic pressure, ρ is the density of the plasma, c is the speed of acoustic waves in the plasma and A is the cross sectional area of the plasma column.

15. A method as recited in claim 14 wherein said plasma production comprises the steps of:

defining a column extending along the longitudinal axis containing an ionizable gas; and ionizing the gas in said defined column.

16. A method as recited in claim 15 wherein an antenna formed by the column is to operate at a frequency, f, and the length, l, of the defined column is given by:

$$l = \frac{V}{f}$$

where V is the acoustic velocity.

* * * * *